US006308497B1

(12) United States Patent
Cassoli et al.

(10) Patent No.: US 6,308,497 B1
(45) Date of Patent: Oct. 30, 2001

(54) APPARATUS FOR DRIVING THE FOLDERS IN MACHINES FOR PACKAGING OR WRAPPING PRODUCTS IN A SHEET OF FLEXIBLE MATERIAL-

(75) Inventors: Paolo Cassoli, Casalecchio Di Reno; Giordano Gorrieri, Pianoro; Giorgio Bonafe', Casalecchio Di Reno, all of (IT)

(73) Assignee: Casmatic S.p.A. (IT)

( * ) Notice: Subject to any disclaimer, the term of this patent is extended or adjusted under 35 U.S.C. 154(b) by 0 days.

(21) Appl. No.: 09/420,508

(22) Filed: Oct. 19, 1999

(30) Foreign Application Priority Data

Oct. 23, 1998 (IT) ..... BO98A0602

(51) Int. Cl.[7] ..... B65B 11/06

(52) U.S. Cl. ..... 53/228; 53/55; 53/52; 493/23

(58) Field of Search ..... 53/228, 466, 55, 53/52; 493/23

(56) References Cited

U.S. PATENT DOCUMENTS 5,038,549 * 8/1991 Nordstrom .
5,331,788 * 7/1994 Cinotti .
5,533,322 * 7/1996 Bacon et al. .
5,540,802 * 7/1996 Totani .
5,566,531 * 10/1996 Nordstrom et al. .
6,000,199 * 12/1999 Boldrini .

* cited by examiner

*Primary Examiner*—Eugene Kim
(74) *Attorney, Agent, or Firm*—Larson & Taylor, PLC

(57) ABSTRACT

The lower folders (P1, P2) of the packaging machine are driven by a rod and crank system (1, 2) moved by an electric motor (5) with control of speed and phase, regulated by an electronic processor (7) with a corresponding programming and dialogue unit (8). The rod and crank system is designed and arranged in such a way that, when the folders are closed, the rod (1) is aligned with the crank (2), and this position (K) is taken to be the zero position by the said processor and is detected for this purpose by a sensor (6). To drive the folders through a complete cycle of closing and opening, the motor (5) has to execute only one pulse, to transfer the rod and crank system from one to the other of two limit positions (K1, K2), spaced apart from the said zero position by an identical distance which is variable, according to the format of the products to be packaged, by means of the said programming unit (8). The rod and crank system is also preferably designed in such a way that, when the product has the maximum format, the motor (5) executes intermittent rotations through 360°, always in the same direction, with a cyclical stop in a position opposite to the zero position (K).

5 Claims, 1 Drawing Sheet

APPARATUS FOR DRIVING THE FOLDERS IN MACHINES FOR PACKAGING OR WRAPPING PRODUCTS IN A SHEET OF FLEXIBLE MATERIAL-

DESCRIPTION

The invention relates to machines for packaging or wrapping products in a sheet of flexible material, of plastic material for example, which is wrapped, folded and then sealed on to the products, and for these machines it proposes an apparatus capable of limiting the work and the power of the motors which drive the lower folders or other actuators having reciprocating motion of variable amplitude.

The characteristics of the apparatus in question and the state of the prior art will be made clear by the following description of a preferred embodiment of the apparatus, illustrated by way of example in the figures of the attached sheet of drawing, in which.

Figure 1:
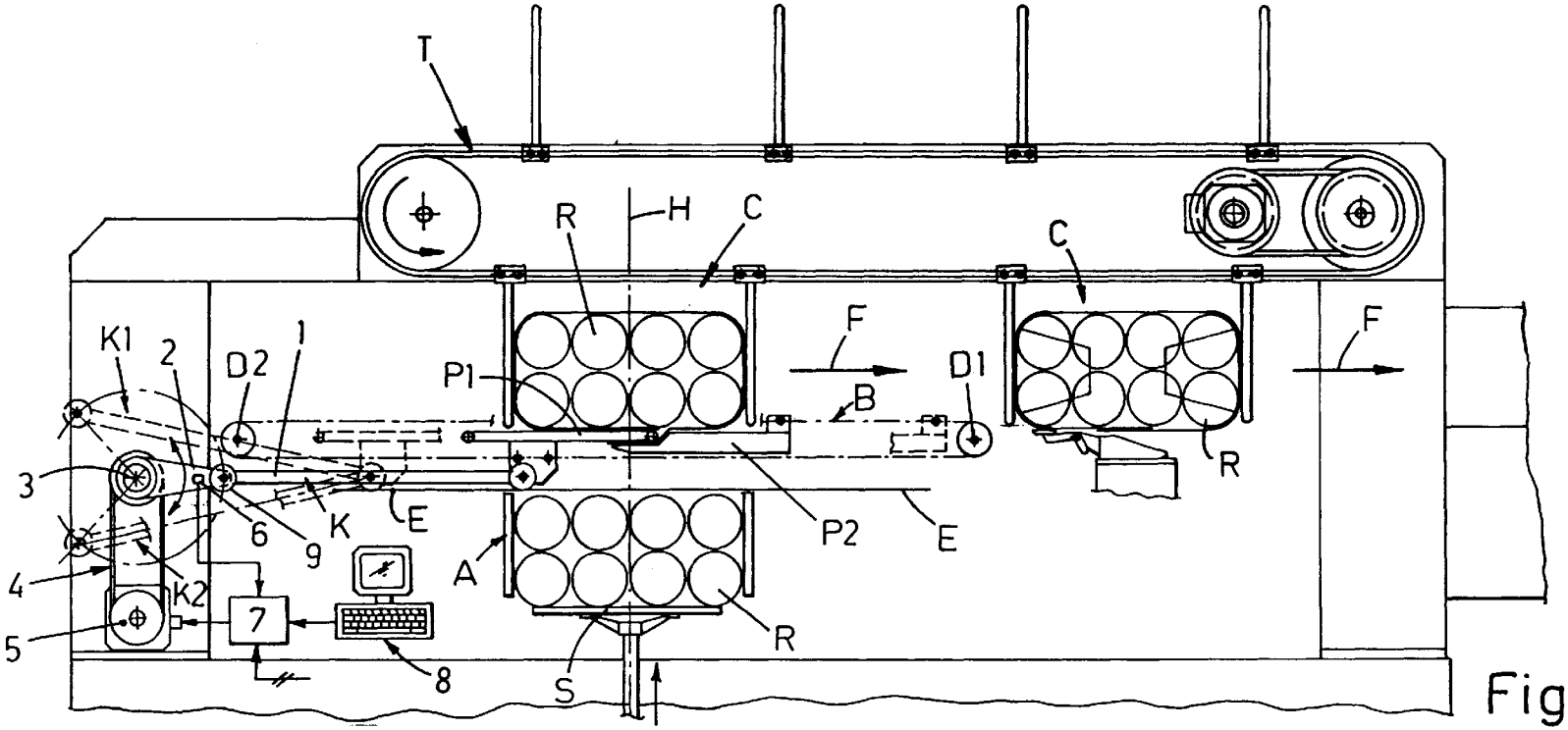
FIG. 1 is a schematic view of a lateral elevation of a packaging machine of the type in question, provided with the new apparatus.

In FIG. 1 it may be seen that a packaging machine of the type in question comprises a conveyor T with horizontal axes, provided with housings C whose size is adjustable, usually in a self-centering way, and which, when moving along the lower run of the said conveyor, stop with their position centered on the top of a hopper A of adjustable size, in which there operates a lifter S which forms a group of rolls R of paper drawn from the production line and which, when so commanded, lifts the said group of rolls and transfers them into the said housing. After such lifting, a sheet E of packaging material, for example plastic material, has now been positioned on the hopper by known means (not illustrated).

In the rest of the description, the group of rolls R will be denoted by the term "product" for convenience of explanation. From the walls of the housing, following the raising of the lifter S, the sheet E is made to wrap the product R and to project below it with flaps of an exact length, which are then folded under the product and overlapped on each other by a pair of lower folders P1 and P2 which are mounted on corresponding rectilinear and horizontal guides, which are not illustrated, and which are driven with a reciprocating rectilinear motion by a self-centering mechanism which normally comprises, on each side of the folders, a secondary belt conveyor B, which has its runs parallel to the said guides, and passes at its ends around shafts D1 and D2 parallel to those of the main conveyor T, the folders being connected to the two opposite runs of the secondary conveyors B, in such a way that when a folder is pushed under the housing C the other folder is also moved simultaneously in this direction, and vice versa. When the format of the products R to be packaged varies, and therefore when the size of the hopper A and of the housings C of the main conveyor T varies, the open position of the folders also varies, with equal spacing from the vertical median axis H of the lifter S which is taken as the zero reference point.

Figure 2:
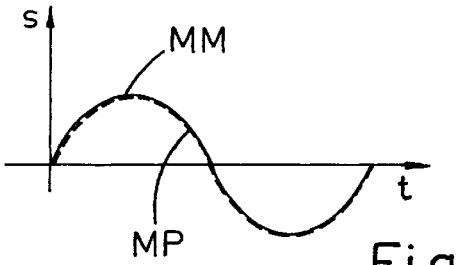
FIG. 2 shows the movement diagrams of the motor and folders in a known machine.

At the present time, the folders are moved by a geared motor or a motor which drives one of the shafts D1 or D2 of the secondary conveyors B, or by mechanisms which produce a reciprocating rectilinear motion, connected to one of the folders or to one of the runs of the said conveyors B. One mechanism which is sometimes used is that of the rod and crank type, with the rod keyed to the shaft of a geared motor or a motor which executes cyclical movements in one direction and in the other, in a number equal to the number of closing and opening movements of the folders. This condition is illustrated in the diagram in FIG. 2 where the movement of the aforesaid motor is indicated by a continuous line and by the symbol MM, while the movement of the folders is indicated by the symbol MP and by a broken line.

A first part of the double wave represents a first pulse of the motor and the corresponding closing movement of the folders, while the other part of the double wave represents a second pulse of the motor, opposite to the preceding one, and the corresponding opening movement of the folders. In the known solution, the crank never overcomes the condition of alignment with the rod. It is clear that, with the known solution, high speed operation requires the use of motors of considerable power which are capable of rapidly reversing their motion, and it is equally clear that the continual interruptions and reversals of the rotation of the motor produce vibrations which are difficult to eliminate and which inevitably limit the integrity and service life of the mechanism which generates the reciprocating movement.

The object of the invention is to overcome these and other disadvantages with the following solution. The secondary conveyors B are, for example, connected with their lower runs to lugs of the folder P1, and these are hinged to corresponding identical and parallel rods 1 which in turn are hinged to identical and parallel cranks 2, keyed to the ends of a shaft 3 supported rotatably by the base of the machine. This shaft is connected directly or through a positive transmission 4, of the belt and toothed pulley type for example, to a motor 5 of the type with electronic control of speed and phase, for example a "brushless" motor, with its corresponding accessories and fitted with a braking unit.

Figure 3:
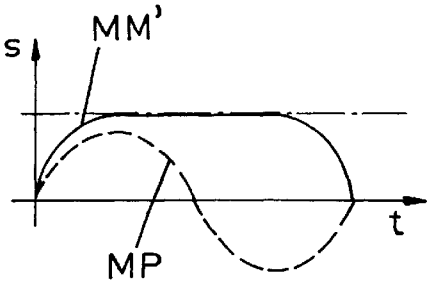
FIG. 3 shows the movement diagrams of the motor and folders in a machine having the apparatus according to the invention.

According to the invention, the rod and crank system is designed and arranged in such a way that when the components 1 and 2 of this system are aligned with each other, for example as in the position indicated by K and shown in FIG. 1 by a continuous line, the folders P1 and P2 are in the closed position under the product to be wrapped. In this position, which is taken to be the zero position, at least one of the cranks 2, or any other component of the mechanism in question, can be made to interact with a fixed sensor 6, of the proximity type for example, connected to the processor 7 which controls the operation of the said motor 5 and which in turn is connected to a programming and dialogue unit 8. The apparatus designed in this way operates as follows. When the folders P1 and P2 are in the open position, outside the housing C, the rod and crank system 1–2 is in one of the end positions indicated, for example, by the broken line and by K1 or K2 in FIG. 1. To drive the folders P1 and P2 with a closing and opening movement MP, as indicated by the oscillation shown in broken lines in FIG. 3 and as stated previously with reference to FIG. 2, the electric motor 5 now has to execute only one pulse MM', in other words a start and stop, and does not have to execute a reversal as in the prior art, since the crank 2 now has to move from the position K1 to the position K2, or vice versa.

Clearly, the apparatus in question can be driven by a motor of limited power, since the rapid reversing of the motion of the folders is executed by the rod and crank system, while the motor 5 continues to rotate in one direction. When the system reaches the limit positions K1 or K2, the motor 5 must stop temporarily to allow the lifter S to rise, and therefore the motor is not required to execute a rapid reversal of the motion, and for this reason also it may be of limited power. Finally, the system is such that, when moving into the position K, corresponding to the closed position of the folders, the system decelerates and accelerates in a natural way, and therefore the motor 5 only has to control the acceleration on starting and the deceleration on stopping.

Figure 4:
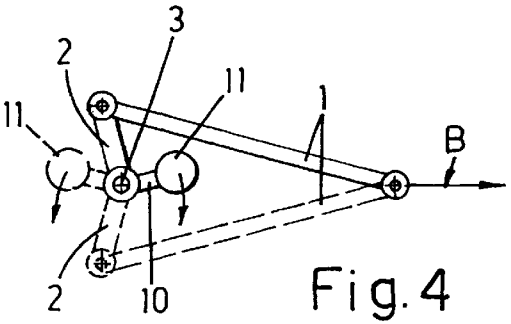
FIG. 4 shows schematically and in lateral elevation a variant embodiment of the apparatus.

If the cranks 2 are provided with a ballast of sufficient weight 9 on the end hinged to the corresponding rods and/or by keying to the middle of the shaft 3 an arm 10 as shown in FIG. 4, moved out of alignment, for example, by ninety degrees with respect to the rods 2, or with variable alignment, and provided with a ballast 11 of sufficient weight at its end, it is possible to provide a dynamically balanced system which requires minimum force from the motor to start from the position K1 or K2, since the ballast 11, when left free to move, tends to start the rod and crank system under the effect of gravity.

Whenever the system passes through the reversing point K, the sensor 6 transmits to the processor 7 a signal which is used as a zero position signal, from which the electronic motor control system starts to count, to stop the crank 2 in the angular position, relative to the format of the product to be packaged, which was initially preset by means of the programming unit 8.

The rod and crank units 1–2 can advantageously be designed in such a way that, when the product R to be packaged has the maximum format, the shaft 3 rotates cyclically through 360°, always in the same direction, passing from the position K to an opposite position, which is not illustrated in the drawings, since it is evident to those skilled in the art.

The product wrapped by the sheet E in the station above the loading hopper A is then moved from the housings of the main conveyor T and transferred to successive known stations which follow each other in the direction indicated by the arrow F in FIG. 1, which complete the closing of the package and which have not been illustrated here, since they are unnecessary for the understanding of the invention.

What is claimed is:

1. An apparatus for driving folders having reciprocating motion of variable amplitude in machines for packaging or wrapping products with a sheet of flexible material, said machines comprising:

a conveyor with housings of adjustable size into which the product is cyclically inserted with an overlying packaging sheet, the lower flaps of which sheets are subsequently folded and overlapped by a pair of folders which run on parallel guides, and wherein one of the folders is connected to the lower run and the other to the upper run of a pair of parallel synchronized conveyors, one of the folders being hinged to parallel and identical rods which in turn are hinged to parallel and identical cranks keyed to a common shaft which is driven by an electric motor;

the motor being of the type with a programmable electronic control of the speed and phase, the motor being provided with braking means, and wherein the rods and cranks are designed and arranged in such a way that, when the folders are in the closed position, the rods and the cranks are aligned with each other, this aligned position is taken as a zero reference point and;

a sensor connected to a programmable processor to detect the zero reference point to control the operation of the motor, wherein in order to drive the folders through a complete cycle of closing and opening, the motor executes only one pulse to transfer the rods and cranks from one to the other of two limit positions, which limit positions are spaced apart from the zero reference point by an identical distance which can be varied according to the format of the products to be packaged.

2. The apparatus according to claim 1, in which the rods and cranks are designed such that, when the product has the maximum format, the motor executes intermittent rotations through 360°, always in the same direction, with a cyclical stop in a position opposite the zero reference point.

3. The apparatus according to claim 1, in which the electric motor is of the brushless type.

4. The apparatus according to claim 1, in which a weight acting as a flywheel is located on the end of a crank which is hinged to a rod.

5. The apparatus according to claim 1, in which at least one arm, spaced angularly by a certain distance from the cranks and provided at its end with a weight acts as a flywheel, and is capable of being fixed perpendicularly in a median position on the shaft on which the cranks are keyed.

* * * * *